US006194846B1

(12) United States Patent
Van Veldhuizen

(10) Patent No.: US 6,194,846 B1
(45) Date of Patent: Feb. 27, 2001

(54) STARTER CIRCUIT WITH A SAFETY SWITCH

(75) Inventor: Robert H. Van Veldhuizen, Terneuzen (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/288,397

(22) Filed: Apr. 8, 1999

(30) Foreign Application Priority Data

Apr. 17, 1998 (EP) ..... 98201237

(51) Int. Cl.[7] ..... H05B 41/14; H05B 41/19

(52) U.S. Cl. ..... 315/309; 315/289; 315/100; 315/103

(58) Field of Search ..... 315/289, 309, 315/310, 240, 241 R, 94, 95, 106, 100, 101, 103, 104, 46, 47, 74, 75, 225, 96, 97, 98, 99, 102, 105

(56) References Cited

U.S. PATENT DOCUMENTS 2,464,748 * 3/1949 Hodgkins ..... 315/100
5,059,870 * 10/1991 Choon ..... 315/289
5,420,479 * 5/1995 Iida et al. ..... 315/309
5,886,481 * 3/1999 Flory, IV ..... 315/309

FOREIGN PATENT DOCUMENTS 815365 7/1949 (DE) .

* cited by examiner

*Primary Examiner*—David Vu
*Assistant Examiner*—Wilson Lee

(57) ABSTRACT

A start circuit (1) includes a series connection of a glow switch (10) and a safety switch (12), which are each provided with an enclosed space (10*a*, 12*a*), with a pair of current conductors (10*b*, 10*c* resp. 12*b*, 12*c*) which enter the enclosed space and with a bimetallic element (10*e* resp. 12*e*) which is arranged in the enclosed space and which is connected with one (10c resp. 12*c*) of the current supply connectors. The enclosed space (10*a*) of the glow switch (10) is provided with an ionisable filling. The glow switch (10) is opened in cold state. The safety switch is closed in cold state. The start circuit (1) comprises a heat source (11) for opening the safety switch (12). The start circuit further comprises a heat source for keeping the safety switch (12) open which is formed by an ionisable filling in the enclosed space (12*a*) of the safety switch (12).

6 Claims, 2 Drawing Sheets

STARTER CIRCUIT WITH A SAFETY SWITCH

BACKGROUND OF THE INVENTION

The invention relates to a starter circuit comprising a series arrangement of a glowswitch and a safety switch, which glowswitch and safety switch are each provided with an enclosed space, with a pair of current conductors which enter the respective enclosed space. A bimetal element is arranged in the enclosed space and is connected to one of the current conductors, the enclosed space of the glowswitch being provided with an ionizable filling. The glowswitch is open in the cold state, and the safety switch is closed in the cold state, while in addition the starter circuit comprises a heat source for opening the safety switch and a heat source for keeping the safety switch open.

Such a starter circuit is known from DE 815 365. The glowswitch is the heat source for opening the safety switch in the known starter circuit. The glowswitch and the safety switch are thermally coupled to one another for this purpose. A resistor shunting the safety switch acts as a heat source for keeping the safety switch open.

The known starter circuit serves for igniting a low-pressure discharge lamp with preheatable electrodes. The known starter circuit for this purpose forms part of a circuit in which the low-pressure discharge lamp is connected in series with an inductive impedance having connection terminals and in which the starter circuit shunts the discharge lamp and is connected in series with the electrodes.

When the connection terminals are connected to a supply source, the glowswitch alternately enters an open and a closed state. In the closed state, a current flows through the electrodes via the starter circuit. This current brings the electrodes of the discharge lamp to a temperature at which a sufficient degree of electron emission occurs for enabling the discharge lamp to ignite.

A transition from the closed state to the open state of the glowswitch interrupts the current through the electrodes of the lamp, so that the inductive element connected in series with the lamp will generate an ignition voltage pulse. If this ignition voltage pulse effects a discharge between the electrodes of the discharge lamp, the voltage across the discharge lamp, and accordingly the voltage between the current conductors of the glowswitch, drops so strongly that the glowswitch remains in its open state. The contact between the current conductors and the glowswitch remains broken then.

If, however, repeated ignition efforts do not lead to a discharge in the low-pressure discharge lamp, the safety switch is heated owing to the thermal coupling to the glowswitch to such an extent that the bimetal element of the safety switch is bent. The safety switch thus assumes an open position. As a result of this, a current will start to flow through the resistive impedance which shunts the safety switch. The heat generated in this resistive impedance keeps the safety switch in its open state, so that no further ignition pulses are generated. It is a disadvantage that the time elapsing until the moment the safety switch enters a closed state again after switching-off of the supply source, called recovery time hereinafter, is comparatively long. This renders it more difficult to determine whether it is sufficient to replace the lamp or whether there is another defect.

SUMMARY OF THE INVENTION

It is an object of the invention to provide a starter circuit which has a shorter recovery time. According to the invention, the starter circuit of the kind described in the opening paragraph is for this purpose characterized in that the heat source for keeping the safety switch open is formed by an ionizable filling in the enclosed space of the safety switch. The ionizable filling of the safety switch is, for example, a rare gas or a mixture of rare gases, as is the filling of the glowswitch, for example a mixture of the rare gases Ne and Xe, for example Ne95Xe5 (mole %), Ne99Xe1, or, for example, a mixture of the rare gases Ne and Ar, for example Ne99Ar1, or Ne25Ar75. The filling pressure may lie in a range from 10 to 100 mbar.

A glow discharge will arise between the current conductors of the safety switch when the heat source for opening the safety switch causes the safety switch to open in the case of an ignition failure of the lamp. The heat generated in the glow discharge keeps the bimetal element of the safety switch in the open state. Since the ionizable filling of the safety switch has a negligibly small heat capacity, in contrast to a resistive impedance, the bimetal element of the safety switch can cool down quickly after the supply source has been switched off.

The heat source for opening the safety switch is, for example, the glowswitch, in which case the glowswitch is thermally coupled to the safety switch. In a practical embodiment, the heat source for opening the safety switch is a resistive impedance which is thermally coupled to the bimetal element of the safety switch and which is connected in series with the glowswitch. To enhance the thermal coupling, the resistive impedance may be fastened to the safety switch, for example, by means of a thermally conductive glue or a metal strip. Preferably, the resistive impedance is a power resistor, for example a wire5 wound resistor. The moment at which the safety switch opens in the case of a defective lamp may be readily chosen by means of the resistance value of the resistive impedance. In practice, the resistive impedance will have a value which lies in a range from 5 to 100 Ω.

In a favorable embodiment, the glowswitch is shunted by a branch which comprises an impedance. The voltage available for maintaining a glow discharge between the current conductors of the safety switch is made higher thereby. This widens the range of possibilities for choosing the safety switch.

Preferably, the impedance is a capacitive impedance. so as to counteract malfunctions in the switching of the glowswitch. It is favorable when the branch comprises a series arrangement of the capacitive impedance and the resistive impedance. The resistive impedance limits currents through the capacitive impedance, so that less stringent requirements need be imposed on the capacitive impedance and on the current conductors of the glowswitch starter.

Unlike the glowswitch, the safety switch is closed in the cold state. Apart from this difference, the safety switch may be realized by means of technologies and materials which are usual in the field of glowswitches and are accordingly familiar to those skilled in the art.

DETAILED DESCRIPTION OF THE PREFERRED EMBODIMENTS

Figure 1:
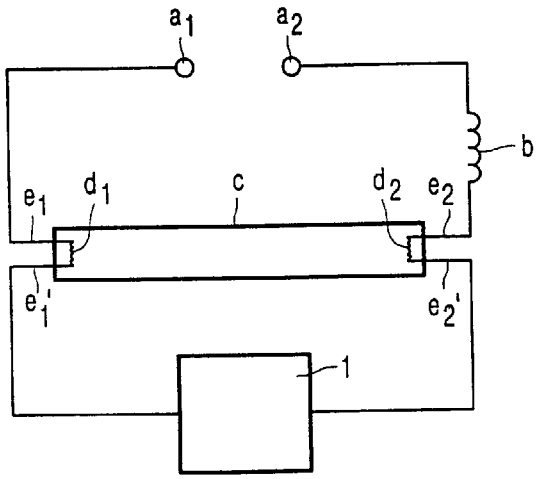
FIG. 1 diagrammatically shows a circuit arrangement provided with a starter circuit.

FIG. 1 shows a circuit arrangement provided with an inductive impedance b, a discharge lamp c, and a starter circuit 1. The circuit arrangement has connection terminals a1, a2 for connection to a supply source, such as the public mains. The discharge lamp c is connected to the input terminals a1, a2, an inductive impedance b being connected between one of the input terminals (a2 in this case) and the electrode d2 connected thereto. The starter circuit 1 shunts the lamp c and is connected in series with the electrodes d1 and d2.

Figure 2:
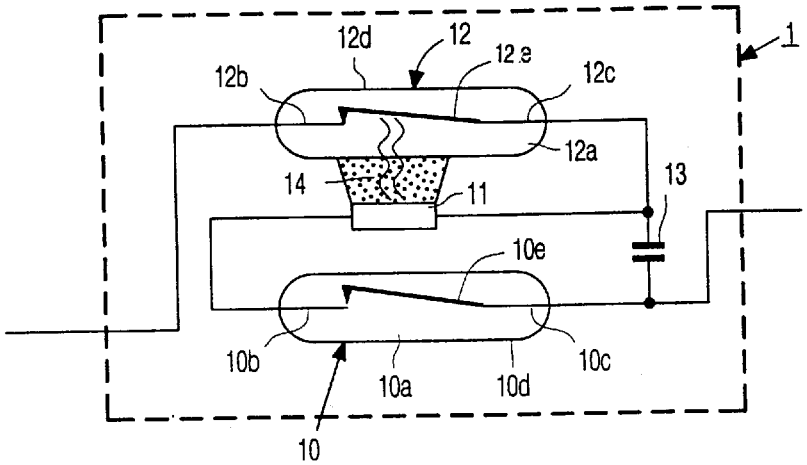
FIG. 2 shows a first embodiment of the starter circuit according to the invention.

A first embodiment of the starter circuit 1 according to the invention is shown in more detail in FIG. 2. The starter circuit 1 comprises a series arrangement of, in that order, a glowswitch 10, a resistive impedance 11, and a safety switch 12. The glowswitch 10 and the safety switch 12 are each provided with a space 10*a*, 12*a* surrounded by a vessel 10*d*, 12*d*, respectively. A pair of current conductors 10*b*, 10*c* is passed through the vessel 10*d* of the glowswitch 10 so as to enter the enclosed space 10*a*. A bimetal element 10*e* connected to one of the current conductors 10*b*, 10*c* (to 10*c* in this case) is arranged inside the enclosed space 10*a* of the glowswitch 10. The bimetal element 10*e* has an active side of Ni20Fe74Mn6 (% by weight) and a passive side of Ni36Fe64. The passive side faces the other current conductor 10*b*. The glowswitch 10 is open in the cold state. The enclosed space 10*a* of the glowswitch 10 is provided with an ionizable filling, in this case Ar75Ne25 (mole %) with a filling pressure of 35 mbar. A pair of current conductors 12*b*, 12*c* is passed through the vessel 12*d* of the safety switch 12 so as to enter the enclosed space 12*a*. A bimetal element 12*e* connected to one of the current conductors 12*b*, 12*c* (to 12*c* in this case) is arranged inside the enclosed space 12*a* of the safety switch 12. The bimetal element 12*e* of the safety switch 12 again has an active side of Ni20Fe74Mn6 (% by weight) and a passive side of Ni36Fe64. The active side of the safety switch 12, however, faces the other current conductor 12*b*. The safety switch 12 is closed in the cold state. The starter circuit 1 further comprises a heat source for opening the safety switch, formed by the resistive impedance 11 connected in series with the glowswitch 10 in this embodiment. The resistive impedance 11 is constructed as a wire-wound resistor with a value of 12 Ω. The resistive impedance 11 is thermally coupled, by radiation and conduction, to the bimetal element 12*e* of the safety switch 12. To enhance the thermal coupling, the resistive impedance 11 is fastened to the safety switch 12 by means of a thermally conductive glue 14.

The starter circuit 1 further comprises a heat source for keeping the safety switch 12 open. According to the invention, this heat source is formed by an ionizable filling in the enclosed space 12*a* of the safety switch 12, here Ne90Ar10 (mole %) with a filling pressure of 60 mbar.

The glowswitch 10 is shunted by a branch which comprises an impedance 13. The impedance 13 here is a capacitive impedance. IEC standard 7.12.1 allows a maximum capacitive value of 20 nF. The capacitive impedance 13 used here is a capacitor with a value of 5 nF. In the embodiment shown, the branch comprises a series arrangement of the capacitive impedance 13 and the resistive impedance 11.

The starter circuit 1 according to the invention operates as follows. The glowswitch 10 is open in the cold state and the safety switch 12 closed. When the circuit arrangement is switched on, a glow discharge will arise between the current conductors 10*b*, 10*c* in the enclosed space 10*a* of the glowswitch 10. This glow discharge heats the bimetal element 10*e* of the glowswitch 10. The bimetal element 10*e*, which is connected to current conductor 10*c*, is heated under the influence of the above heating effect such that it makes contact with the current conductor 10*b*. The creation of this contact extinguishes the glow discharge, and a current will flow through the electrodes dl and d2 of the discharge lamp c inter alia through the resistive impedance 11 of the starter circuit 1 and through the inductive impedance b. This current heats the electrodes d1 and d2 of the discharge lamp c up to a temperature at which a sufficient electron emission occurs for enabling a correct discharge lamp to ignite. After the glow discharge in the glowswitch 10 has been extinguished, the bimetal element 10*e* of the glowswitch 10 cools down, whereby it is deformed such that the glowswitch 10 enters an open state. As a result of this, the current through the lamp c is interrupted and the inductive impedance b generates an ignition voltage pulse. The glowswitch will remain open if the lamp c ignites as a result of the ignition voltage pulse. If the lamp c fails to ignite, a glow discharge will again arise between the current conductors 10*b*, 10*c* of the glowswitch 10, whereupon the process of heating-up of the electrodes d1 and d2 and of generating an ignition voltage pulse will repeat itself. Heat is generated in the resistive impedance 11 as a result of the current flowing through it during the time intervals when the glowswitch 10 is closed. The bimetal element 12*e* of the safety switch 12, thermally coupled to the resistive impedance 11, is heated thereby.

Figure 3:
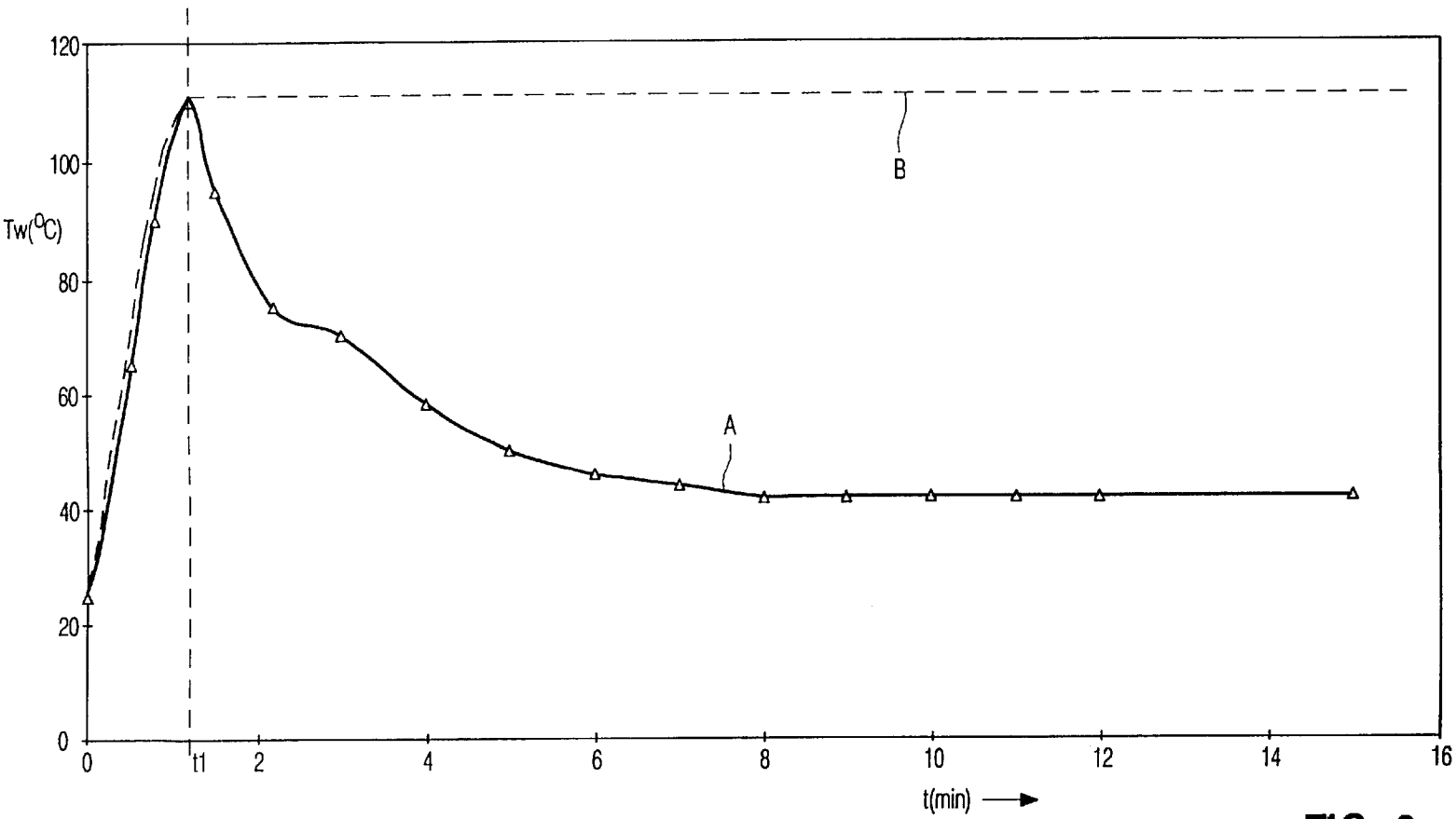
FIG. 3 shows a temperature as a function of time.

In FIG. 3, curve A represents the wall temperature Tw of the safety switch 12 as a function of the time which has elapsed after the circuit arrangement described above was switched on. The wall temperature Tw in the example shown in FIG. 3 has risen to a comparatively high value of 110° C. after a failure to ignite at moment t1 (1.2 min) on the part of the lamp c. The bimetal element 12*e* of the safety switch is then deformed to such an extent that the safety switch 12 enters an open state. With the safety switch 12 in the open state, a glow discharge will arise between its current conductors 12*b* and 12*c*. This glow discharge is maintained by a current which flows through the capacitive impedance 13 and possibly through the glowswitch 10 and the resistive impedance 11. The glow discharge in the enclosed space 12*a* of the safety switch 12 releases heat which keeps the safety switch in its open state, so that a generation of further ignition voltage pulses does not take place. Substantially no heat generation takes place any more in the resistive impedance 11 with the safety switch 12 in the open state, so that the wall temperature Tw decreases in a few minutes to a comparatively low value of approximately 45° C.

In the starter circuit known from DE 815 365, the filling in the enclosed space of the safety switch is chosen such that no discharge can take place therein. In the known starter circuit, where a resistive impedance serves as the external heat source for keeping the safety switch open, the comparatively high wall temperature Tw is maintained also after the safety switch has been opened (see curve B in FIG. 3). It takes a comparatively long time, accordingly, after switching-off of the circuit arrangement before the safety switch has cooled down sufficiently for assuming a closed state again.

In the starter circuit according to the invention, by contrast, this closed state is maintained by means of the glow discharge in the ionizable filling in the enclosed space 12*a* of the safety switch after the safety switch 12 has been opened. The components outside the safety switch 12 can accordingly cool down the moment the safety switch is opened. The starter circuit according to the invention thus has a shorter recovery time.

Figure 4:
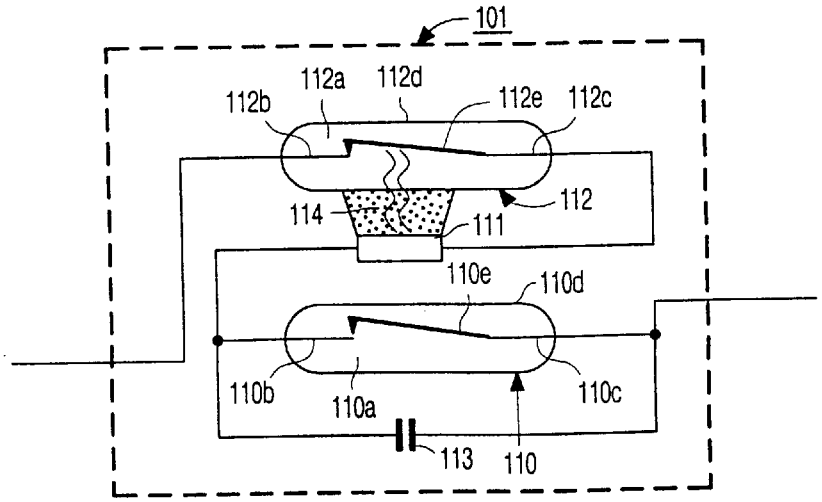
FIG. 4 shows a second embodiment of the starter circuit according to the invention.

A resistive impedance 11 having a comparatively high resistance value is necessary for the generation of sufficient heat for the safety switch 12 if the starter circuit shown in FIG. 2 is used in a circuit arrangement for starting and supplying low-pressure discharge lamps of comparatively low power ratings. In the embodiment of FIG. 2, a comparatively high resistance value does not adversely affect the interference suppression effect of the capacitive impedance 13, in particular for higher harmonics of the supply voltage. In the embodiment of FIG. 4, however, such an adverse affection does exist in case of the inpedance 11 having a relatively high impedance value. For this reason the embodiment shown in FIG. 4 only functions satisfactorily in case of a comparatively low value of the resistance of impedance 11.

Components corresponding to those of FIG. 2 have reference numerals which are 100 higher here. In the embodiment of FIG. 4, the glowswitch 110 is shunted by a branch which comprises exclusively a capacitive impedance 113. The embodiment of FIG. 4 is attractive for use in circuit arrangements for starting and supplying low-pressure discharge lamps of comparatively low power. In this embodiment, too, the heat source for opening the safety switch is a resistive impedance 111. The fact that the glowswitch 110 is exclusively shunted by the capacitive impedance 113, however, means that the resistive impedance 111 can have a comparatively high resistance value without adversely affecting the interference suppression effect of the capacitive impedance 113.

What is claimed is:

1. A starter circuit (1) comprising a series arrangement of a glowswitch (10) and a safety switch (12), which glowswitch and safety switch are each provided with an enclosed space **(10*a*, 12*a*), with a pair of current conductors (10*b*, 10*c*; 12*b*, 12*c*) which enter the respective enclosed space, and with a bimetal element (10*e*, 12*e*) which is arranged in the enclosed space and is connected to one of the current conductors (10*c*, 12*c*), the enclosed space (10*a*) of the glowswitch (10) being provided with an ionizable filling, the glowswitch (10) being open in the cold state, and the safety switch (12) being closed in the cold state, while in addition the starter circuit (1) comprises a heat source (11) for opening the safety switch (12) and a heat source for keeping the safety switch (12) open, the heat source for keeping the safety switch open comprising an ionizable filling in the enclosed space (12*a*) of the safety switch (12)**.

2. A starter circuit as claimed in claim 1, characterized in that the heat source for opening the safety switch (12) is a resistive impedance (11) which is thermally coupled to the bimetal element **(12*e*) of the safety switch (12) and which is connected in series with the glowswitch (10)**.

3. A starter circuit as claimed in claim 2, characterized in that the glowswitch (10) is shunted by a branch which comprises an impedance (13).

4. A starter circuit as claimed in claim 3, characterized in that the impedance is a capacitive impedance (13).

5. A starter circuit as claimed in claim 4 wherein the branch comprises a series arrangement of the capacitive impedance (13) and the resistive impedance (11).

6. A starter circuit as claimed in claim 4, characterized in that the branch comprises exclusively the capacitive impedance (113).

* * * * *